US009316382B2

(12) United States Patent
Rowlette

(10) Patent No.: US 9,316,382 B2
(45) Date of Patent: Apr. 19, 2016

(54) CONNECTOR DEVICES, SYSTEMS, AND RELATED METHODS FOR CONNECTING LIGHT EMITTING DIODE (LED) MODULES

(71) Applicant: CREE, Inc., Durham, NC (US)

(72) Inventor: John R. Rowlette, Raleigh, NC (US)

(73) Assignee: Cree, Inc., Durham, NC (US)

( * ) Notice: Subject to any disclaimer, the term of this patent is extended or adjusted under 35 U.S.C. 154(b) by 322 days.

(21) Appl. No.: 13/756,005

(22) Filed: Jan. 31, 2013

(65) Prior Publication Data

US 2014/0213094 A1 Jul. 31, 2014

(51) Int. Cl.

| | |
|---|---|
| ***F21V 21/00*** | (2006.01) |
| ***F21V 19/00*** | (2006.01) |
| *F21Y 101/02* | (2006.01) |

(52) U.S. Cl.

CPC ..... *F21V 19/0035* (2013.01); *F21Y 2101/02* (2013.01); *Y10T 29/49204* (2015.01)

(58) Field of Classification Search

CPC ..... F21V 19/003; F21V 23/06; F21V 17/005; F21V 17/06; F21V 17/002; F21V 17/18; F21V 19/0035; F21V 19/0045; F21V 29/246; F21V 29/004; F21V 29/242; F21V 3/02; Y10T 29/49204

See application file for complete search history.

(56) References Cited

U.S. PATENT DOCUMENTS

| | | | |
|---|---|---|---|
| 1,099,061 | A | 6/1914 | Lane |
| D47,607 | S | 7/1915 | Owen |
| D109,740 | S | 5/1937 | Stewart |
| D134,595 | S | 11/1941 | Van Es |
| D158,821 | S | 5/1950 | Walter |
| D199,141 | S | 9/1964 | Curry |
| D231,679 | S | 5/1974 | Keller |

(Continued)

FOREIGN PATENT DOCUMENTS

| | | |
|---|---|---|
| CN | 3557377 | 8/2006 |
| EM | 000380670-0001 | 8/2005 |

(Continued)

OTHER PUBLICATIONS

Author Unknown, "White Paper: Breakthrough video technology solves persistent image problems with fluorescent lights and LEOs, while maintaining wide dynamic range," 2009, Pixim, Inc., 7 pages.

(Continued)

*Primary Examiner* — Diane Lee
*Assistant Examiner* — Naomi M Wolford
(74) *Attorney, Agent, or Firm* — Jenkins, Wilson, Taylor & Hunt, P.A.

(57) ABSTRACT

Connector devices, systems, and related methods for connecting light emitting diode (LED) modules to thermal substrates and/or optical elements are disclosed. In some aspects, a connector device can include a connector body having a first side configured to engage an LED module and a second side configured to engage an optical element for mechanically coupling the LED module to the optical element. The connector device can further include a housing configured to receive a portion of an electrical wire for electrically coupling the LED module to the electrical wire. A connector system can include an annular body defining an opening and at least one LED module disposed in a portion of the connector. The connector can be configured to cover a portion of the LED module and leave another portion of the LED module exposed or visible.

73 Claims, 7 Drawing Sheets

(56) References Cited

U.S. PATENT DOCUMENTS

| | | | |
|---|---|---|---|
| D231,680 | S | 5/1974 | Keller |
| D238,185 | S | 12/1975 | Wellward et al. |
| 4,918,497 | A | 4/1990 | Edmond et al. |
| 4,946,547 | A | 8/1990 | Palmour |
| 4,966,862 | A | 10/1990 | Edmond et al. |
| 5,027,168 | A | 6/1991 | Edmond et al. |
| 5,034,869 | A | 7/1991 | Choi |
| D325,999 | S | 5/1992 | Sonneman |
| D326,537 | S | 5/1992 | Gattari |
| 5,200,022 | A | 4/1993 | Kong |
| 5,210,051 | A | 5/1993 | Carter et al. |
| D341,442 | S | 11/1993 | Shapiro |
| 5,338,944 | A | 8/1994 | Edmond et al. |
| 5,359,345 | A | 10/1994 | Hunter et al. |
| RE34,861 | E | 2/1995 | Davis et al. |
| 5,393,993 | A | 2/1995 | Edmond et al. |
| 5,416,342 | A | 5/1995 | Edmond et al. |
| 5,477,441 | A | 12/1995 | Budnovitch et al. |
| 5,523,589 | A | 6/1996 | Edmond et al. |
| D375,605 | S | 11/1996 | Balish, Jr. |
| 5,604,135 | A | 2/1997 | Edmond et al. |
| 5,631,190 | A | 5/1997 | Negley et al. |
| D383,564 | S | 9/1997 | Lecluze |
| 5,664,869 | A | 9/1997 | Bitton |
| D386,805 | S | 11/1997 | Bonnette et al. |
| D392,764 | S | 3/1998 | Balish, Jr. |
| 5,739,554 | A | 4/1998 | Edmond et al. |
| D397,472 | S | 8/1998 | Lecluze |
| D399,021 | S | 9/1998 | Lam |
| 5,800,038 | A | 9/1998 | McCool |
| D399,590 | S | 10/1998 | Lecluze |
| D400,274 | S | 10/1998 | Ziaylek, Jr. et al. |
| D411,640 | S | 6/1999 | Lueken et al. |
| 5,912,477 | A | 6/1999 | Negley et al. |
| D413,997 | S | 9/1999 | Jandrisits et al. |
| D421,316 | S | 2/2000 | Fiorato |
| 6,100,643 | A | 8/2000 | Nilssen |
| 6,120,600 | A | 9/2000 | Edmond et al. |
| D433,179 | S | 10/2000 | Johnson |
| 6,152,582 | A | 11/2000 | Klaus |
| 6,187,606 | B1 | 2/2001 | Edmond et al. |
| 6,193,392 | B1 | 2/2001 | Lodhie |
| 6,201,262 | B1 | 3/2001 | Edmond et al. |
| D457,677 | S | 5/2002 | Landefeld et al. |
| D459,504 | S | 6/2002 | Chen |
| D468,044 | S | 12/2002 | Lam |
| D468,477 | S | 1/2003 | Landefeld et al. |
| D473,966 | S | 4/2003 | Lecluze |
| D474,298 | S | 5/2003 | Lecluze |
| 6,600,175 | B1 | 7/2003 | Baretz et al. |
| 6,644,834 | B2 | 11/2003 | Christen |
| D488,251 | S | 4/2004 | Benghozi |
| D488,583 | S | 4/2004 | Benghozi |
| 6,791,119 | B2 | 9/2004 | Slater, Jr. et al. |
| 6,834,515 | B2 | 12/2004 | Sunder et al. |
| 6,853,010 | B2 | 2/2005 | Slater et al. |
| D506,280 | S | 6/2005 | Chen |
| 6,913,371 | B2 | 7/2005 | Ping |
| D508,141 | S | 8/2005 | Rashidi |
| D508,750 | S | 8/2005 | Rashidi |
| D509,017 | S | 8/2005 | Rashidi |
| D509,615 | S | 9/2005 | Rashidi |
| 6,948,829 | B2 | 9/2005 | Verdes et al. |
| 6,958,497 | B2 | 10/2005 | Emerson |
| 7,095,056 | B2 | 8/2006 | Vitta et al. |
| 7,144,135 | B2 | 12/2006 | Martin et al. |
| 7,213,940 | B1 | 5/2007 | Van De Ven |
| D544,979 | S | 6/2007 | Hartmann, Jr. et al. |
| D547,484 | S | 7/2007 | Guercio |
| D548,390 | S | 8/2007 | Lecluze |
| D549,384 | S | 8/2007 | Grawunder |
| 7,297,381 | B2 | 11/2007 | Cojocariu et al. |
| D558,377 | S | 12/2007 | Rashidi |
| D558,378 | S | 12/2007 | Rashidi |
| D560,204 | S | 1/2008 | Bhavnani |
| D561,374 | S | 2/2008 | Hartmann, Jr. et al. |
| D570,515 | S | 6/2008 | Flaherty et al. |
| D574,104 | S | 7/2008 | Sanoner |
| 7,396,146 | B2 | 7/2008 | Wang |
| 7,456,499 | B2 | 11/2008 | Loh et al. |
| D588,296 | S | 3/2009 | Sabernig |
| D588,735 | S | 3/2009 | Woodard |
| 7,502,054 | B2 | 3/2009 | Kalapathy et al. |
| D591,894 | S | 5/2009 | Flank |
| 7,549,772 | B2 | 6/2009 | Wang |
| D596,334 | S | 7/2009 | Sabernig |
| 7,564,180 | B2 | 7/2009 | Brandes |
| 7,566,154 | B2 | 7/2009 | Gloisten et al. |
| 7,588,351 | B2 | 9/2009 | Meyer |
| 7,614,769 | B2 | 11/2009 | Sell |
| D606,696 | S | 12/2009 | Chen et al. |
| D607,140 | S | 12/2009 | Farris et al. |
| D608,044 | S | 1/2010 | Pickett |
| D609,840 | S | 2/2010 | Tang |
| D610,292 | S | 2/2010 | Yoshinobu et al. |
| 7,655,957 | B2 | 2/2010 | Loh et al. |
| 7,677,767 | B2 | 3/2010 | Chyn |
| D614,337 | S | 4/2010 | Robinson et al. |
| D617,934 | S | 6/2010 | Rashidi |
| D622,434 | S | 8/2010 | Ward et al. |
| 7,771,086 | B2 | 8/2010 | Goverde |
| 7,789,535 | B2 | 9/2010 | Wang et al. |
| 7,802,901 | B2 | 9/2010 | McMillan |
| D625,876 | S | 10/2010 | Chen et al. |
| D625,879 | S | 10/2010 | Sabernig |
| 7,810,965 | B2 | 10/2010 | Weaver |
| 7,821,023 | B2 | 10/2010 | Yuan et al. |
| D626,676 | S | 11/2010 | Johnson |
| D628,733 | S | 12/2010 | Cobb, III et al. |
| 7,862,214 | B2 | 1/2011 | Trott et al. |
| D632,822 | S | 2/2011 | Bitton |
| 7,918,591 | B2 | 4/2011 | Lynch |
| 7,952,544 | B2 | 5/2011 | Roberts |
| 7,960,819 | B2 | 6/2011 | Loh et al. |
| 7,999,283 | B2 | 8/2011 | Chakraborty et al. |
| 8,018,135 | B2 | 9/2011 | Van De Ven et al. |
| D646,429 | S | 10/2011 | Sabernig |
| 8,044,418 | B2 | 10/2011 | Loh et al. |
| 8,058,088 | B2 | 11/2011 | Cannon et al. |
| 8,092,035 | B2 | 1/2012 | Mandy et al. |
| 8,104,928 | B1 | 1/2012 | Horn |
| 8,125,137 | B2 | 2/2012 | Medendorp et al. |
| D655,855 | S | 3/2012 | Sabernig |
| D656,263 | S | 3/2012 | Ogawa et al. |
| 8,142,057 | B2 | 3/2012 | Roos et al. |
| 8,240,871 | B2 | 8/2012 | Chou |
| 8,253,346 | B2 | 8/2012 | Budike, Jr. |
| 8,264,138 | B2 | 9/2012 | Negley et al. |
| D671,259 | S | 11/2012 | Chen |
| D671,668 | S | 11/2012 | Rowlette, Jr. et al. |
| D672,899 | S | 12/2012 | Van De Ven et al. |
| 8,337,071 | B2 | 12/2012 | Negley et al. |
| D674,127 | S | 1/2013 | Rowlette, Jr. et al. |
| 8,344,629 | B2 | 1/2013 | Deixler |
| 8,348,471 | B2 | 1/2013 | Huang et al. |
| 8,480,268 | B2 | 7/2013 | Wilson et al. |
| D692,171 | S | 10/2013 | Randolph et al. |
| 8,563,339 | B2 | 10/2013 | Tarsa et al. |
| 8,564,000 | B2 | 10/2013 | Hussell et al. |
| D694,456 | S | 11/2013 | Rowlette, Jr. et al. |
| D695,941 | S | 12/2013 | Rashidi |
| 8,596,837 | B1 * | 12/2013 | Wronski ..... 362/373 |
| 8,643,288 | B2 | 2/2014 | Otake et al. |
| 8,783,917 | B2 | 7/2014 | Mrakovich |
| 8,801,217 | B2 | 8/2014 | Oehle et al. |
| 8,829,799 | B2 | 9/2014 | Recker et al. |
| 8,858,045 | B2 | 10/2014 | Harbers et al. |
| 8,890,435 | B2 | 11/2014 | Bora et al. |
| 8,894,253 | B2 | 11/2014 | Rowlette, Jr. et al. |
| 8,940,561 | B2 | 1/2015 | Donofrio et al. |
| 9,024,349 | B2 | 5/2015 | Chitnis et al. |
| 9,070,850 | B2 | 6/2015 | Keller et al. |
| 2006/0044152 | A1 | 3/2006 | Wang |
| 2006/0221272 | A1 | 10/2006 | Negley et al. |

(56) References Cited

U.S. PATENT DOCUMENTS

| | | | | |
|---|---|---|---|---|
| 2007/0035951 | A1 | 2/2007 | Tseng | |
| 2007/0247855 | A1* | 10/2007 | Yano | 362/294 |
| 2008/0158887 | A1 | 7/2008 | Zhu et al. | |
| 2008/0179611 | A1 | 7/2008 | Chitnis et al. | |
| 2009/0050908 | A1 | 2/2009 | Yuan et al. | |
| 2009/0283779 | A1 | 11/2009 | Negley et al. | |
| 2010/0226139 | A1 | 9/2010 | Lynch et al. | |
| 2011/0002124 | A1 | 1/2011 | Chang et al. | |
| 2011/0026261 | A1 | 2/2011 | Kuan | |
| 2012/0218760 | A1* | 8/2012 | Nagaoka et al. | 362/249.02 |
| 2012/0230028 | A1 | 9/2012 | Foo | |
| 2012/0236563 | A1* | 9/2012 | Breidenassel et al. | 362/249.02 |
| 2012/0286661 | A1* | 11/2012 | Salter et al. | 315/77 |
| 2012/0293997 | A1* | 11/2012 | Zaderej | 362/235 |
| 2013/0033872 | A1 | 2/2013 | Randolph et al. | |
| 2014/0001952 | A1 | 1/2014 | Harris et al. | |
| 2014/0003061 | A1 | 1/2014 | Chen et al. | |
| 2015/0008829 | A1 | 1/2015 | Lurie et al. | |

FOREIGN PATENT DOCUMENTS

| | | | |
|---|---|---|---|
| FR | 2909160 | A1 | 5/2008 |
| WO | WO 03/055273 | A2 | 7/2003 |
| WO | WO 2008/036596 | A1 | 3/2008 |
| WO | WO 2008/059445 | A2 | 5/2008 |
| WO | WO 2008/061082 | A1 | 5/2008 |
| WO | WO 2008/067447 | A1 | 6/2008 |
| WO | WO 2009/111905 | A1 | 9/2009 |
| WO | WO 2011/037878 | A1 | 3/2011 |

OTHER PUBLICATIONS

International Search Report for PCT/US2011/062992 mailed Apr. 2, 2012, 2 pages.

International Search Report for PCT/US2011/062990 mailed Apr. 12, 2012, 2 pages.

Quayle Action for U.S. Appl. No. 29/379,154 mailed May 30, 2012, 6 pages.

Non-final Office Action for U.S. Appl. No. 13/042,378 mailed Sep. 4, 2012, 19 pages.

Restriction Requirement for U.S. Appl. No. 29/408,232 mailed Jan. 16, 2013, 5 pages.

Final Office Action for U.S. Appl. No. 13/042,378 mailed Feb. 4, 2013, 20 pages.

International Search Report for PCT/US2012/067754 mailed Feb. 20, 2013, 11 pages.

Examiner's Answer to Appeal Brief for U.S. Appl. No. 13/042,378, mailed Aug. 6, 2013, 20 pages.

Notice of Allowance for U.S. Appl. No. 29/456,927, mailed Sep. 18, 2013, 8 pages.

Non-Final Office Action for U.S. Appl. No. 13/042,388, mailed Oct. 18, 2013, 12 pages.

Notice of Allowance for U.S. Appl. No. 29/408,234, mailed Mar. 14, 2014, 5 pages.

Notice of Allowance for U.S. Appl. No. 29/469,362, mailed Mar. 25, 2014, 5 pages.

Quayle Action for U.S. Appl. No. 13/042,388, mailed May 27, 2014, 4 pages.

International Search Report and Written Opinion for PCT/US2014/023887, mailed Jun. 13, 2014, 7 pages.

International Preliminary Report on Patentability for PCT/US2012/067754, mailed Jun. 19, 2014, 8 pages.

Notice of Allowance for U.S. Appl. No. 13/042,388, mailed Jul. 21, 2014, 9 pages.

Non-Final Office Action for U.S. Appl. No. 13/649,531 dated Jul. 31, 2014.

First Office Action for Chinese Patent Application No. 201280023405.6, issued Dec. 9, 2014, 17 pages.

Final Office Action for U.S. Appl. No. 13/649,531 dated Dec. 16, 2014.

First Office Action for Chinese Patent Application No. 201280068226.7, issued Dec. 17, 2014, 29 pages.

Non-Final Office Action for U.S. Appl. No. 13/868,021, mailed Apr. 17, 2015, 10 pages.

Non-Final Office Action for U.S. Appl. No. 13/800,656, mailed Jun. 4, 2015, 16 pages.

Final Office Action for U.S. Appl. No. 13/868,021, mailed Jul. 23, 2015, 11 pages.

Non-Final Office Action for U.S. Appl. No. 13/649,531 dated Jun. 4, 2015.

Final Office Action for U.S. Appl. No. 13/649,531 dated Oct. 8, 2015.

* cited by examiner

CONNECTOR DEVICES, SYSTEMS, AND RELATED METHODS FOR CONNECTING LIGHT EMITTING DIODE (LED) MODULES

TECHNICAL FIELD

The subject matter disclosed herein relates generally to mechanical and/or electrical connectors. More particularly, the subject matter disclosed herein relates to connector devices, systems, and methods for connecting light emitting diode (LED) modules to other components such as thermal substrates and/or optical elements.

BACKGROUND

In recent years, there has been a movement towards replacing incandescent light bulbs with lighting fixtures or products that employ more efficient lighting technologies. One such technology that shows tremendous promise employs light emitting diode (LED) chips. Compared with incandescent bulbs, LED-based light fixtures are much more efficient at converting electrical energy into light and are longer lasting, and as a result, lighting fixtures that employ LED technologies are expected to replace incandescent bulbs in residential, commercial, and industrial applications.

Manufacturers of LED lighting products are constantly seeking ways to reduce their cost in order to provide a lower initial cost to customers, and encourage the adoption of LED products. Connectors incorporating fewer components which allow LED based modules to exhibit sustained or increased brightness levels are becoming more desirable. Conventional connectors can employ messy and/or costly soldering processes and materials. To date, there are no solderless connectors that are also configured to efficiently mechanically and electrically connect an LED chip based module within a light fixture while also increasing brightness levels, in part, by covering electrical components or electrical controls. That is, conventional connectors can leave electrical components of LED modules exposed, thereby allowing the components to block, absorb and/or otherwise interfere with light.

Thus, despite the availability of various connectors in the marketplace, a need remains for connector devices, systems, and/or methods which can be produced with fewer parts and/or processing steps, efficiently, and at a lower cost. Such connector devices, systems, and/or methods can make it easier for end-users to justify switching to LED based products from a return on investment or payback perspective.

SUMMARY

In accordance with this disclosure, connector devices, systems, and related methods are provided and described herein. Connector devices, systems, and methods described herein can advantageously exhibit improved processing times, fewer parts, fewer processing steps, ease of manufacture, lower processing costs, and/or contribute to increased brightness and/or improved optical properties. Connector devices and systems described herein can be well suited for a variety of applications such as connecting light emitting diode (LED) chip based modules within lighting fixtures for personal, industrial, and commercial lighting applications including, for example, light bulbs and light fixture products and/or applications.

In some aspects, connector devices can comprise a connector body having a first side configured or adapted to engage an LED module and a second side configured to engage an optical element for mechanically coupling the LED module to the optical element. The optical elements can comprise interchangeable lenses, bulbs, reflectors, and/or diffusers. The connector device can further comprise a housing configured to receive a portion of an electrical wire for electrically coupling the LED module to the electrical wire. Improved color mixing and white light output can be achieved via the interchangeable optical elements.

A connector system can comprise an annular body defining an opening for receiving at least one LED module. The connector can be configured to cover a first portion of the LED module having electrical components, and leave another portion of the LED module exposed or visible. It is, therefore, an object of the present disclosure to provide connector devices, systems, and methods having improved brightness by covering portions of the LED module which can absorb, block, or interfere with light.

A method of connecting a light emitting diode (LED) module to another component can, for example, comprise providing a connector, providing an LED module over a first side of a connector body, sliding an optical element over a tab provided on a second side of the connector body, and inserting an electrical wire into a housing of the connector body for electrically coupling the wire to the LED module. Notably, the connector can provide a solderless system for connecting LED module to electrical components.

These and other objects of the present disclosure as can become apparent from the disclosure herein are achieved, at least in whole or in part, by the subject matter disclosed herein.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Figure 1:
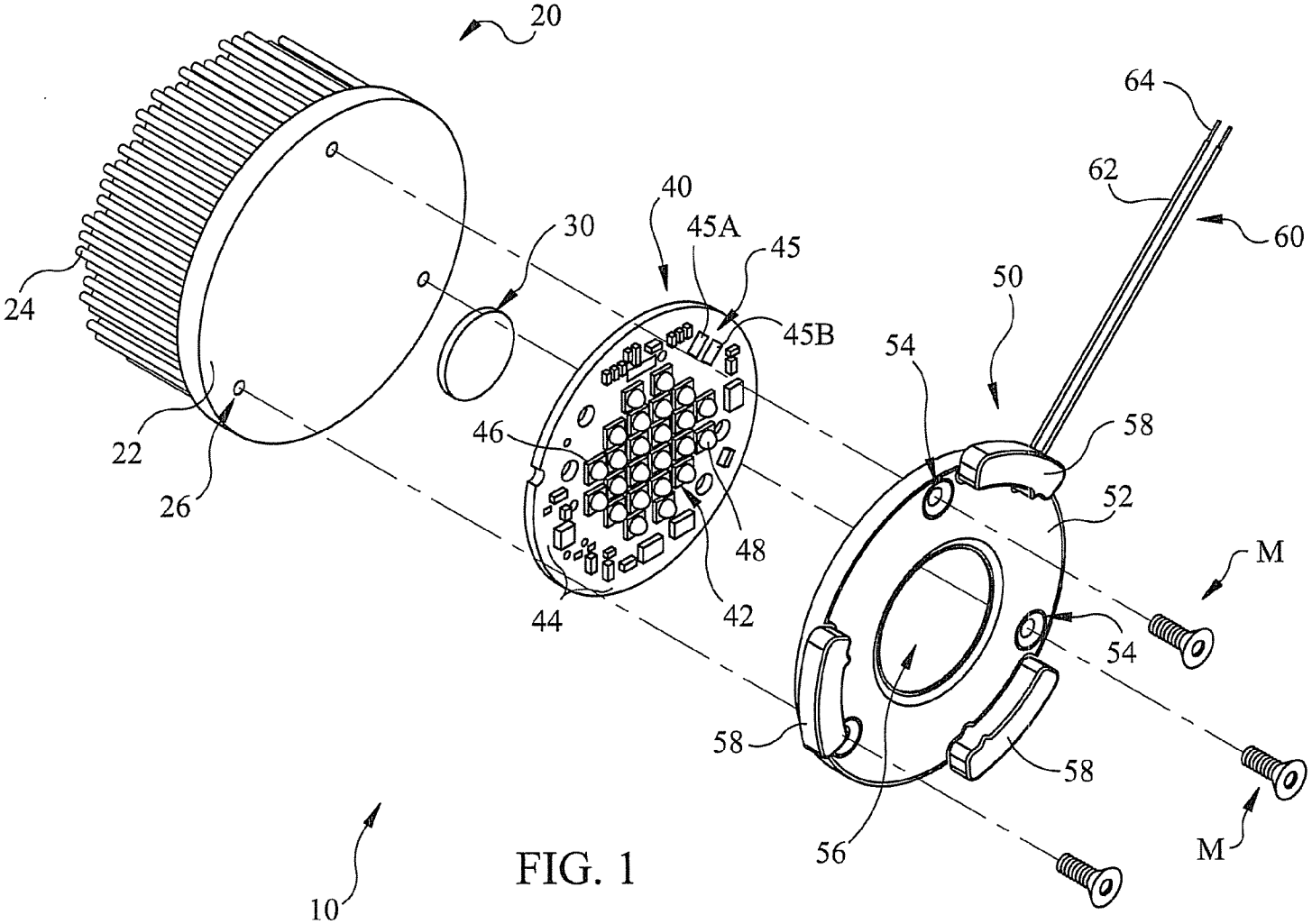
FIG. 1 is an exploded view illustrating a connector system according to a first embodiment of the disclosure herein.

The subject matter disclosed herein is directed to connector devices and systems for connecting LED modules to other components, and related methods. Devices, systems, and methods provided herein can provide for solderless electrical connections which improve ease of installation, manufacture, and reduce cost.

In some aspects, connector devices, systems, and methods disclosed herein can comprise securing an LED module to a thermal substrate for improving thermal management.

In some aspects, connector devices, systems, and methods disclosed herein can comprise provision of interchangeable optical elements, and coupling the optical elements to a portion of the LED module. Notably, connector devices and systems disclosed herein can be configured to receive LED modules that have a suitable width or diameter, for example a width or diameter that is greater than 5 mm, greater than 20 mm, or greater than 40 mm.

In some aspects, connector devices, systems, and methods disclosed herein can be configured to cover some portions of the LED module (e.g., electrical components) and leave other portions uncovered.

In some aspects, connector devices and/or systems can be configured to connect and/or secure LED modules within and/or to a portion of a lighting fixture. In some aspects, LED modules as described herein can comprise multiple LED chips and/or packages. In some aspects, LED modules and/or connector devices and systems described herein can, for example, comprise an output of at least approximately 70 lumens per watt (LPW), approximately 80 LPW, approximately 90 LPW, approximately 95 LPW, and/or approximately 100 LPW or more. In some aspects, one or more of the foregoing LPW thresholds can be attained for emissions having at least one of a cool white color temperature, a neutral white temperature, and/or a warm white color temperature.

In some aspects, LED modules and/or connector devices and systems described herein can be operable at 120 volts (V) or more, 230 V or more, and/or 277 V or more. LED modules and/or connector devices and systems can also be dimmable via electrical components disposed on the module.

In some aspects, LED modules and/or connector devices and systems described herein can be configured to deliver white emissions having x, y color coordinates within seven or more MacAdam step ellipses of a reference point on the blackbody locus of a 1931 CIE Chromaticity Diagram. In some aspects, white emissions can have x, y color coordinates within four or more MacAdam step ellipses of a reference point on the blackbody locus of a 1931 CIE Chromaticity Diagram. In some aspects, such a reference point on the blackbody locus may have a color temperature of less than or approximately equal to 7000° K, less than or approximately 5000° K, less than or approximately equal to 4000° K, less than or approximately equal to 3500° K, less than or approximately equal to 3000° K, and/or less than or approximately equal to 2700° K. In some aspects, combined emissions from LED modules as described herein embody at least one of (a) a color rendering index (CRI Ra) value of at least 85, and (b) a color quality scale (CQS) value of at least approximately 85. In some aspects, combined emissions from LED modules and/or connector devices and systems as described herein embody at least one of CRI Ra value of at least approximately 90. In some aspects, combined emissions from LED modules as described herein embody at least one of CRI Ra value of more than 90.

Reference will be made in detail to possible aspects or embodiments of the subject matter herein, one or more examples of which are shown in the figures. Each example is provided to explain the subject matter and not as a limitation. In fact, features illustrated or described as part of one embodiment can be used in another embodiment to yield still a further embodiment. It is intended that the subject matter disclosed and envisioned herein covers such modifications and variations.

As illustrated in the various figures, some sizes of structures or portions are exaggerated relative to other structures or portions for illustrative purposes and, thus, are provided to illustrate the general structures of the present subject matter. Furthermore, various aspects of the present subject matter are described with reference to a structure or a portion being formed on other structures, portions, or both. As will be appreciated by those of skill in the art, references to a structure being formed "on" or "above" another structure or portion contemplates that additional structure, portion, or both may intervene. References to a structure or a portion being formed "on" another structure or portion without an intervening structure or portion are described herein as being formed "directly on" the structure or portion. Similarly, it will be understood that when an element is referred to as being "connected", "attached", or "coupled" to another element, it can be directly connected, attached, or coupled to the other element, or intervening elements may be present. In contrast, when an element is referred to as being "directly connected", "directly attached", or "directly coupled" to another element, no intervening elements are present.

Furthermore, relative terms such as "on", "above", "upper", "top", "lower", or "bottom" are used herein to describe one structure's or portion's relationship to another structure or portion as illustrated in the figures. It will be understood that relative terms such as "on", "above", "upper", "top", "lower" or "bottom" are intended to encompass different orientations of the component in addition to the orientation depicted in the figures. For example, if the component in the figures is turned over, structure or portion described as "above" other structures or portions would now be oriented "below" the other structures or portions. Likewise, if components in the figures are rotated along an axis, structure or portion described as "above", other structures or portions would be oriented "next to" or "left of" the other structures or portions. Like numbers refer to like elements throughout.

Unless the absence of one or more elements is specifically recited, the terms "comprising", "including", and "having" as used herein should be interpreted as open-ended terms that do not preclude the presence of one or more elements.

As used herein, the term "LED module" and "LED based modules" are synonymous and refer to a lighting product incorporating LED chips and/or packages. Connector devices and systems described herein can comprise LED modules and/or LED based modules, and can be configured to emit light from the secured or connected LED module. LED modules and/or LED based modules can be operable to provide a light output which can be manipulated via optics to produce output of different patterns, shapes, designs, intensity, and/or color point.

In some aspects, LED modules and/or LED based modules can deliver over 70 LPW at 90+ CRI in all color temperatures including warm, cool, and neutral white color temperatures ranging from between approximately 2700° K to approximately 3000° K, to approximately 3500° K, to approximately 4000° K, and to approximately 5000° K or more. In some aspects, LED modules and/or LED based modules can deliver over 80 LPW at 90+ CRI in all color temperatures including warm, cool, and neutral white color temperatures. In some aspects, LED modules and/or LED based modules can deliver over 90 LPW at 90+ CRI in all color temperatures including approximately 2700° K to approximately 5000° K or more. In some aspects, LED modules and/or LED based modules can deliver over 95 LPW at 90+ CRI in all color temperatures including approximately 2700° K to approximately 5000° K or more.

LED modules for use in connector devices and systems according to embodiments described herein can comprise group III-V nitride (e.g., gallium nitride (GaN)) based LED chips or lasers. Fabrication of LED chips and lasers is generally known and only briefly described herein. LED chips or lasers can be fabricated on a growth substrate, for example, a silicon carbide (SiC) substrate, such as those devices manufactured and sold by Cree, Inc. of Durham, N.C. Other growth substrates are also contemplated herein, for example and not limited to sapphire, silicon (Si), and GaN. In some aspects, SiC substrates/layers can be 4H polytype silicon carbide substrates/layers. Other SiC candidate polytypes, such as 3C, 6H, and 15R polytypes, however, can be used. Appropriate SiC substrates are available from Cree, Inc., of Durham, N.C., and the methods for producing such substrates are set forth in the scientific literature as well as in a number of commonly assigned U.S. patents, including but not limited to U.S. Pat. No. Re. 34,861; U.S. Pat. No. 4,946,547; and U.S. Pat. No. 5,200,022, the disclosures of which are incorporated by reference herein in their entireties. Any other suitable growth substrates are contemplated herein.

Although various embodiments of LED chips disclosed herein can comprise a growth substrate, it will be understood by those skilled in the art that the crystalline epitaxial growth substrate on which the epitaxial layers comprising an LED chip are grown can be removed, and the freestanding epitaxial layers can be mounted on a substitute carrier substrate or substrate which can have different thermal, electrical, structural and/or optical characteristics than the original substrate. It is understood that connectors can be used with LED modules having multiple LED chips and/or packages of different colors, one or more of which can be white emitting.

In some aspects, one or more LED chips, LED packages, LED modules and/or optics used with connector devices or systems described herein can be at least partially coated with one or more phosphors. The LED modules and/or connector systems can therefore emit a white light combination of blue and yellow light. In other embodiments, the LED chips emit a non-white light combination of blue and yellow light as described in U.S. Pat. No. 7,213,940. LED chips emitting red light or LED chips covered by a phosphor that absorbs the LED light and re-emits a red light are also contemplated herein. LED chips and/or portions thereof can be coated with a phosphor using many different methods, with one suitable method being described in U.S. patent application Ser. Nos. 11/656,759 and 11/899,790, both entitled "Wafer Level Phosphor Coating Method and Devices Fabricated Utilizing Method", and both of which are incorporated herein by reference in their entireties. Other suitable methods for coating one or more LED chips are described in U.S. Pat. No. 8,058,088 entitled "Phosphor Coating Systems and Methods for Light Emitting Structures and Packaged Light Emitting Diodes Including Phosphor Coating" which issued on Nov. 15, 2011, and the continuation-in-part application U.S. patent application Ser. No. 12/717,048 entitled "Systems and Methods for Application of Optical Materials to Optical Elements", the disclosures of which are hereby incorporated by reference herein in their entireties. LED chips and/or portions thereof can also be coated using other methods such as electrophoretic deposition (EPD).

FIGS. 1 through 4D of the drawings illustrate embodiments of connector devices, systems, and/or related methods thereof. In some aspects, connector devices and systems can be configured to secure and/or connect one or more LED modules within and/or to portions of other components such as a light fixture which can comprise electrical wires and/or a thermal substrate. FIG. 1 is an exploded view illustrating a connector system, generally designated 10. As FIG. 1 illustrates and in some aspects, connector system 10 can comprise a thermal substrate or heat sink 20, an optional adhesive or thermal interface material 30, a LED module 40, a connector device 50, and one or more optional mechanical coupling members M. Notably, devices, systems, and methods described herein can provide for solderless electrical connections between LED module 40 and other components, while securing LED module 40 to such components, such as a heat sink 20 or thermal substrate. One or more optics can also be provided and secured to portions of LED module 40, for example, via connector device 50. In some aspects, one or more reflector, diffuser and/or lenses (e.g., FIG. 3) can be secured to LED module 40. Optical components can advantageously provide color mixing capabilities for producing and maintaining a true white light color point from system 10, including warm, neutral, and/or cool white color points.

In some aspects, connector 50 can be configured to receive one or more wires 60 and mechanically, physically, and/or electrically connect LED module 40 to portions of a lighting fixture, such as portions of heat sink 20, wires 60, and/or combinations thereof. That is, heat sink 20, wires 60, and/or combinations thereof can comprise portions of a lighting fixture or power source, to which LED module 40 can be secured or connected via connector 50, thereby forming connector system 10.

In some aspects, heat sink 20 can comprise a portion of a lighting fixture 10 and can be integrally formed therewith. In other aspects, the heat sink can comprise a stand-alone component to be installed with connector 50. In other aspects, connectors 50 having integrally formed heat sinks 20 can be provided and are contemplated herein. In some aspects, heat sink 20 can comprise a substantially cylindrically shaped body having a substantially smooth and/or planar support surface 22. Support surface 22 can be sized and configured to receive and support LED module 40. In some aspects, surface 22 can be configured to receive LED modules 40 varying in width (or diameter), for example from approximately 5 mm to more than approximately 50 mm and any sub-range therebetween, such as approximately 20 mm, 30 mm, or 40 mm. In some aspects, LED module 40 can be mounted directly to portion of support surface 20. In other aspects, an optional adhesive or thermal interface material 30 can be disposed between portions of LED module 40 and support surface 22.

In some aspects, thermal interface material 30 can comprise any thermally conductive material and can be applied at the interface between LED module 40 and support surface 20. In some aspects, thermal interface material 30 can improve dissipation of heat from LED module 40 to heat sink 20, and improve the overall thermal transfer therebetween. LED module 40 can be more efficient and deliver improved brightness at cooler temperatures. In some aspects, thermal interface material 30 can comprise solder. In other aspects, thermal interface material 30 can comprise a thermal mask or material used to fill gaps between thermal transfer surfaces, such as gaps between a substrate of LED module 40 and the support surface 22, in order to increase thermal transfer efficiency.

Heat sink 20 can further comprise one or more outwardly or radially projecting fins 24. In some aspects, fins 24 can be substantially parallel to a central axis of the heat sink 20. In some aspects, support surface 22 can comprise a support base for fins 24, which protrude outwardly therefrom. In some aspects, fins 24 can be substantially vertically aligned and spaced apart to allow sufficient air flow therebetween, thereby improving thermal efficiency of system 10.

Still referring to FIG. 1 and in some aspects, LED module 40 can comprise a substrate having any relatively small form factor (e.g., substantially square, round, non-square, non-round, symmetrical and/or asymmetrical) such as those described herein in reference to FIGS. 4A to 4D. LED module 40 can comprise central portion, generally designated 42. Central portion 42 can be disposed proximate the center of LED module 40 and can comprise a centralized light emission area. In some aspects, the centralized light emission area, central portion 42, can comprise one or more LED packages 46 and/or LED chips. In some aspects, the centralized light emission can comprise a plurality of LED packages 46 arranged in a substantially circular shape or array. In other aspects, the centralized light emission can comprise a plurality of LED packages 46 arranged in a substantially non-circular shape or array. LED packages 46 can comprise a substrate or submount, an LED chip, and an optical element, such as encapsulant material or a lens. In other aspects, LED module 40 can comprise chip on board (COB) LED chips provided with or without a lens or optical element.

Some aspects of the present subject matter may use LED chips, LED packages, fixtures, luminescent materials/elements, power supply elements, control elements, and/or methods such as described in U.S. Pat. Nos. 7,564,180; 7,456,499; 7,213,940; 7,095,056; 6,958,497; 6,853,010; 6,791,119; 6,600,175, 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862, and/or 4,918,497, and U.S. Patent Application Publication Nos. 2010/0252851; 2009/0108281; 2009/0184616; 2009/0080185; 2009/0050908; 2009/0050907; 2008/0308825; 2008/0198112; 2008/0179611, 2008/0173884, 2008/0121921; 2008/0012036; 2007/0253209; 2007/0223219; 2007/0170447; 2007/0158668; 2007/0139923, and/or 2006/0221272; the disclosures of the foregoing patents and published patent applications are hereby incorporated by reference as if set forth fully herein.

In some aspects, LED module 40 can comprise a peripheral portion 44 disposed about central portion 42. In some aspects, one or more electrical components or electrical devices can be disposed in peripheral portion 44. Notably, the one or more electrical components can be covered by portions of connector 50 when secured therein, such that any potential blockage, absorption, and/or other adverse interference of light by such components is reduced, minimized, and/or eliminated.

In some aspects, electrical components disposed in peripheral portion 44 can comprise devices, including for example a microprocessor, configured to control, limit, and/or divert current or voltage about one or more LED packages or chips disposed in central portion 42. In other aspects, electrical components disposed in peripheral portion 44 can comprise one or more transistors, diodes, resistors, switch circuitry and/or devices, dimming circuitry and/or devices, surge protection circuitry and/or devices, control circuitry and/or devices, drive circuitry and/or devices, micro-processing circuitry and/or devices, combinations thereof, and/or any other circuitry components and/or devices.

LED module 40 can further comprise an electrical contact portion, generally designated 45. Electrical contact portion 45 can be configured to electrically communicate to wires 60 for receiving and sending electrical signal to LED module 40 for generation and emission of light. In some aspects, electrical contact portion 45 can comprise first and second electrical contacts 45A and 45B, respectively, disposed in peripheral portion 44 of module 40. First and second electrical contacts 45A and 45B can comprise an anode and a cathode pair configured to pass electrical signal from an external source via wires 60 into LED packages 46 or LED chips for illumination thereof. In some aspects, first and second electrical contacts 45A and 45B can connect to traces or circuitry (not shown) for transferring electrical signal to LED packages 46 or LED chips (e.g., COB LED chips).

In some aspects, first and second electrical contacts 45A and 45B can comprise electrically conductive material that can be deposited, plated, or applied via electroplating, electroless plating, and/or other deposition techniques. For example and in some aspects, first and second electrical contacts 45A and 45B can comprise areas of gold (Au), silver (Ag), copper (Cu), tin (Sn), titanium (Ti), nickel (Ni), palladium (Pd), electroless nickel immersion gold (ENIG), or any combination and/or alloy thereof. However, it is contemplated that any conductive material can be provided to form electrical contacts. In other aspects, first and second contacts 45A and 45B can comprise insulation displacement connectors (IDC) configured to "bite" into, pierce, or otherwise displace insulated portions of the wire and electrically connect to conductive cores of wires 60. In further aspects, first and second contacts 45A and 45B can comprise plug in housings, push-pin connectors, clamps, hooks, spring contacts, or any other contact configured to electrically and/or physically connect to portions of wire 60.

Still referring to FIG. 1, connector system 10 can further comprise connector device 50. Connector device 50 can for example comprise a substantially circular and/or annular shaped body portion 52 configured to at least partially cover electrical components disposed in peripheral portion 44 of LED module. One or more apertures 54 can be provided in body portion 52. Apertures 54 can be configured to receive one or more mechanical coupling members M. In some aspects, coupling members M can extend through portions of connector 50, LED module 40, heat sink 20, and/or any combination thereof. Notably, connecting member 50 can be configured to physically and electrically connect LED module 40 to electrical connectors such as such as wires 60 and/or heat sink 20. In some aspects, a lighting fixture can comprise wires 60 and/or heat sink 20.

In further aspects, body portion 52 of connector 50 can surround and/or define a substantially circular shaped opening 58. In some aspects, central portion 42 of LED module 40 can be visible through opening 58 upon connection. That is, some portions of LED module 40 can be covered (e.g., peripheral portion 44) by connector 50 and other portions of LED module 40 can be uncovered or exposed through portions of connector 50 (e.g., central portion 42). In some aspects, opening 58 can be substantially coaxial with central portion 42 of LED module 40.

Connector 50 can further comprise on or more tabs portions 58 disposed on and/or extending from an external surface of body 52. In some aspects, tab portions 58 can extend from a surface which opposes the surface which faces LED module 40. In some aspects, tabs or tab portions 58 can be configured to physically and/or mechanically connect to portions of one or more optical elements (see e.g., FIG. 3), such as one or more lenses, bulbs, reflectors, reflective surfaces, diffusers, combinations thereof, and/or any other type of optical element configured to shape, pattern, and/or affect angles or a color point light emitted from LED module 40. As described with respect to FIG. 3, optical elements can be optional and can be interchangeable. One or more optical conversion materials, such as one or more phosphors or luminophores can be disposed over portions of the one or more optical elements, where used. Connector 50 can be configured to receive one or more wires 60. In some aspects, wires 60 can comprise an encapsulated wire having an insulated portion 62 and an inner core portion 64. In some aspects, connector 50 can comprise an IDC configured to displace insulated portion 62 to electrically connect to core portion 64.

As can be appreciated, the act of connector device 50 engaging and holding down LED module 40 simultaneously electrically couples LED module 40*t* also where electrical connection is already provided to connector device 50 such as by attachment of wires 60.

Figure 2A:
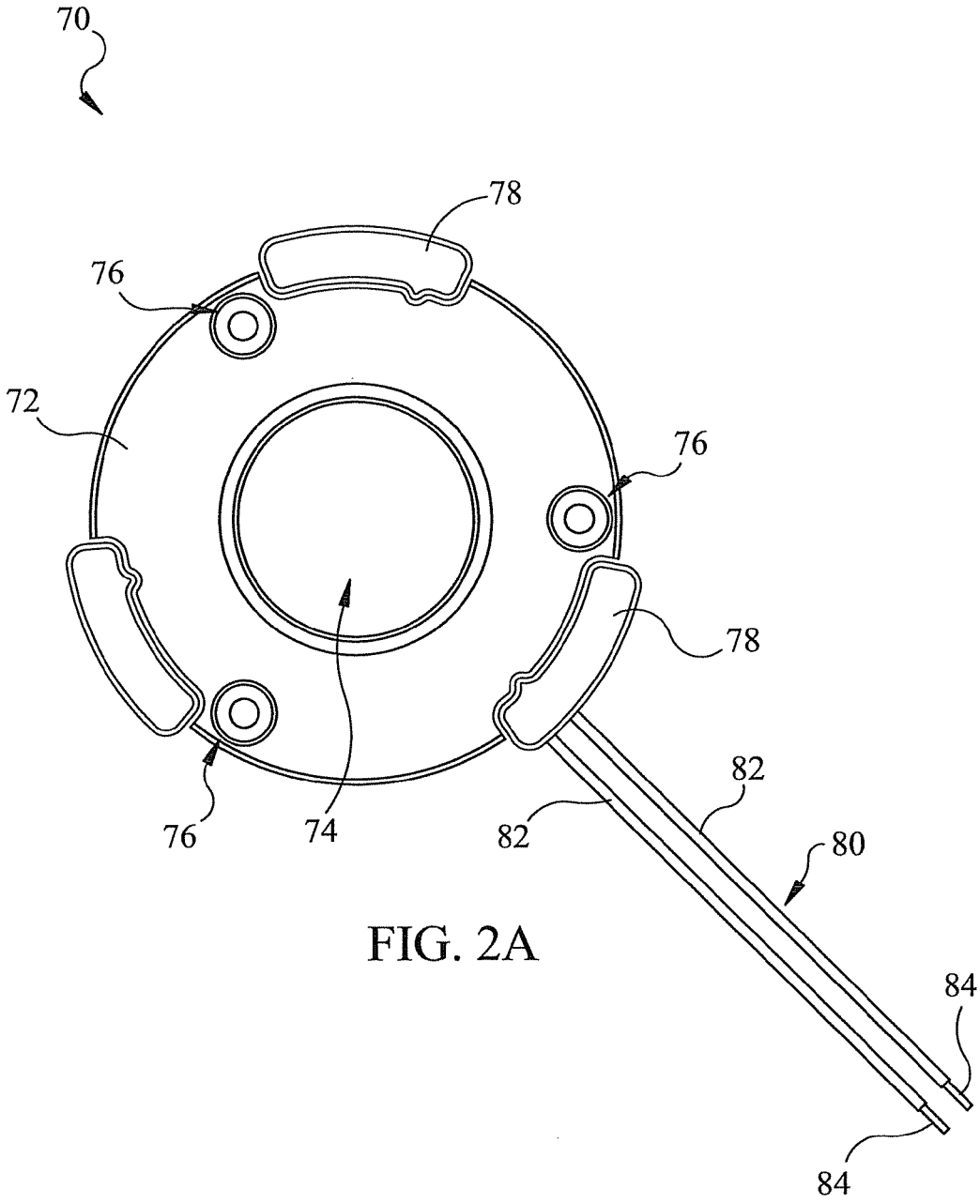
FIGS. 2A, 2B and 2C are top plan, bottom plan, and side views, respectively, illustrating a connector device according to the disclosure herein.
Figure 2B:
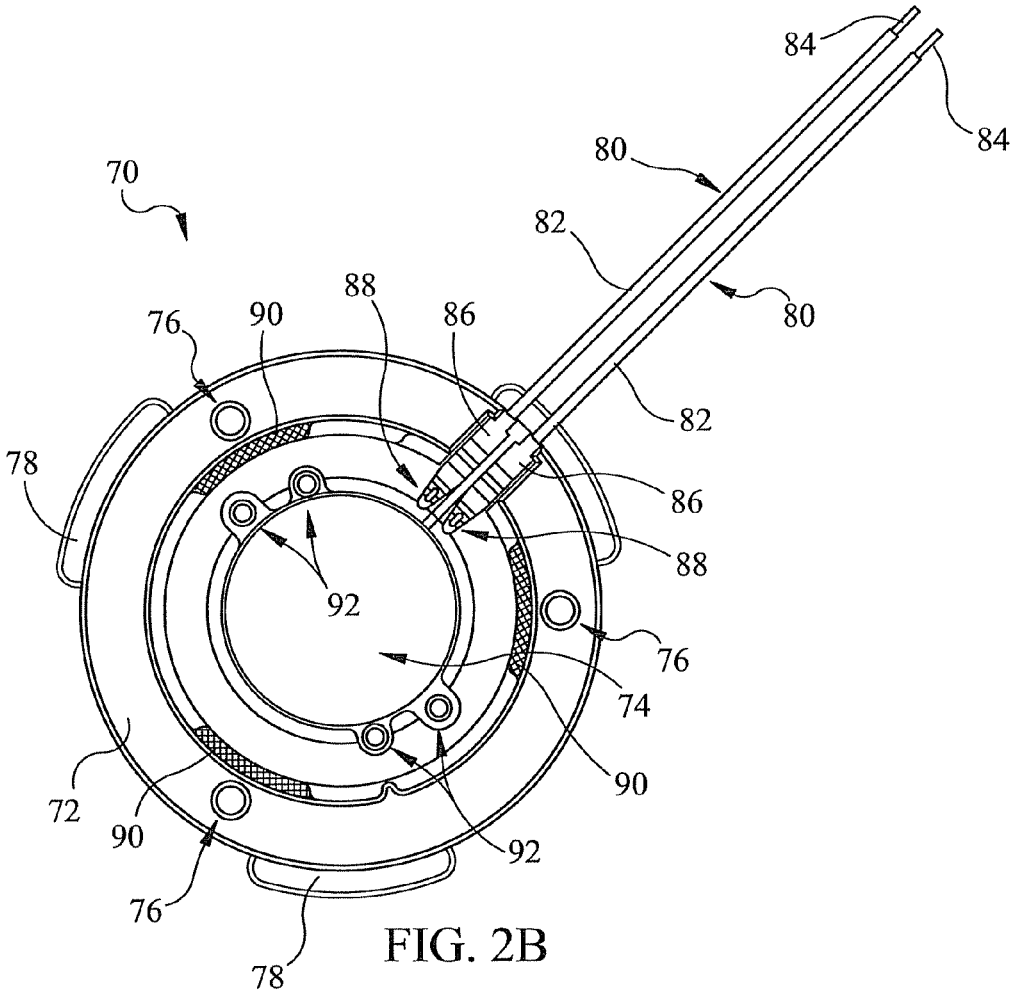
Figure 2C:
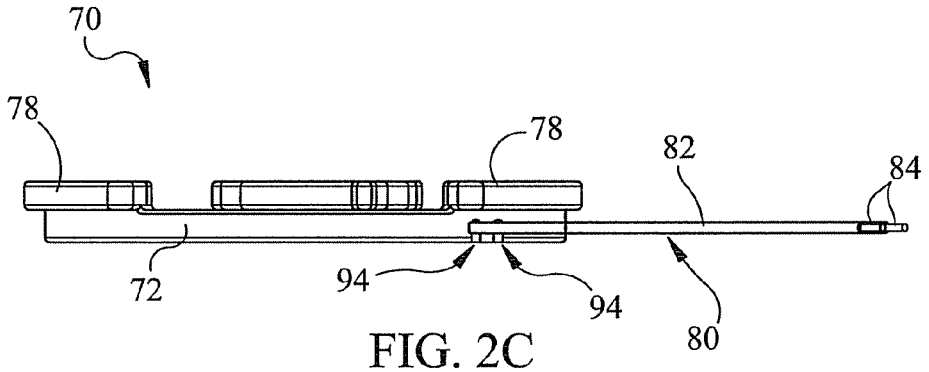

FIGS. 2A, 2B, and 2C provide a front side or top plan view, an opposing back side or bottom plan view, and a side view, respectively, of a connector device, generally designated 70. Connector device 50 was briefly discussed in FIG. 1, however, but FIGS. 2A to 2C illustrate a connector device in more detail. Referring in general to FIGS. 2A to 2C, connector device 70 can be configured to connect an LED module (e.g., 40, FIG. 1) to portions of a light fixture and/or electrical power source, such as electrical wires 80. Notably, connector device 70 can also be configured to connect the LED module (40, FIG. 1) to one or more primary optics, secondary optics, and/or optical elements, such as a lens, bulb, reflector, diffuser, etc.

FIG. 2A illustrates a front side of connector device 70, which can be configured to face and/or directly connect to an optical element, where used. Connector device 70 can comprise a substantially annular shaped body 72 defining an opening 74. Body 72 can comprise any suitable material, such as a plastic or ceramic material, and can optionally comprise metallic coatings in some aspects. In some aspects, body 72 can be reflective and/or comprise a reflective coating to increase brightness. Notably, annular shaped body 72 can be configured to cover one or more electrical components disposed on an LED module (e.g., 40, FIG. 1) for preventing such components from blocking or interfering with light. In some aspects, the electrical components can be disposed in a peripheral or outer portion of the LED module (e.g., 42, FIG. 1). Opening 74 can be configured to provide a space through which one or more LED chips or LED packages (e.g., 46, FIG. 1) of an LED module can be positioned, disposed, and/or located. That is, opening 74 provides a space through which light emitted by the LED module (e.g., 40, FIG. 1) can pass and be viewed.

In some aspects, light exiting from opening 74 can be shaped, manipulated, patterned, and/or converted to a different wavelength or color point by one or more optical elements, where desired. In some aspects, body 72 can comprise a reflective material, one or more reflective surfaces, and can comprise optical mixing, diffusing, and/or optical conversion capabilities. That is, in some aspects, body 72 can be coated or sprayed with one or more diffusing materials, phosphors, and/or lumiphores.

Still referring to FIG. 2A, connector device 70 can further comprise one or more apertures 76 configured to receive a mechanical coupling member (e.g., M, FIG. 1) for securing connector device 70 to a heat sink (e.g., 20, FIG. 1), for securing connector device 70 to an LED module (e.g., 40, FIG. 1), or for securing and connecting portions and/or combinations thereof. In some aspects, connector device 70 can be secured within a connector system as described in FIG. 1. Any type of mechanical coupling member can be positioned and secured to apertures 76, for example, one or more screws, pins, nails, hooks, clips, dowels, rods, etc. In some aspects, mechanical coupling members may not be required, as connector device 70 may be glued or otherwise adhesively secured within portions of a connector system. Notably, connector device 70 can comprise a solderless connection device, which can reduce potential damage to LED chips and/or packages due to thermal stress generated during the soldering process, as well as eliminate costly materials and/or processing steps.

Connector device 70 can also comprise one or more tabs 78. As noted earlier, one or more interchangeable and optional optical devices can be secured to a first surface or side of connector device 70 and an LED module (e.g., 40, FIG. 1) can be connected to an opposing surface or side of connector device 70. In some aspects, optical devices can be adapted for convenient and simple installation, for example, by sliding, snapping, hooking, looping, locking, and/or otherwise engaging onto or about tabs 78.

Connector device 70 can further comprise one or more openings or housings configured to receive one or more wires 80 from an electrical power source (not shown). In some aspects, wires 80 can comprise a portion of a light fixture. In some aspects, wires 80 can comprise a conductive core portion 84 encapsulated within insulation 82. Notably, wires can be directly received in a back or side of body 72, such that soldering may be unnecessary. In some aspects, portions of wires 80 can be received within a housing portion of body 72, as discussed below.

FIG. 2B illustrates a back side of connector device 70, which opposes the view of FIG. 2A. In some aspects, connector device 70 can comprise adjacent housing portions 86 configured to receive portions of wires 80. In some aspects, wires 80 can snap, click, or otherwise become engaged within housing portions 80. In some aspects, each housing portion 86 can for example comprise an IDC configured to bite through or displace insulation 82 of wires 80 and electrically connect to core portion 84. Connector can receive electrical signal carried via wires 80 and transfer the electrical signal into an LED module (e.g., 40, FIG. 1) via conductive tips or conductive projections 88 extending from housing portions 86. Conductive projections 88 can electrically communicate with and/or transfer electrical signal received from wires 80 into first and second electrical contacts (e.g., 45A and 45B) disposed on LED module (e.g., 40, FIG. 1). Notably, connector device 70 can be configured for electrically connecting a power source, such as wires 80 from a lighting fixture, with an LED module (e.g., 40, FIG. 1) for causing the illumination thereof. Connector device 70 can also be configured for physically and mechanically coupling LED modules (e.g., 40, FIG. 1) to portions of the lighting fixture, for example, to a heat sink (e.g., 20, FIG. 1) of a lighting fixture to form a connector system.

Still referring to FIG. 2B and in some aspects, connector device 70 can comprise ledges or ridges disposed about an inner surface of body 72. For example and in some aspects, connector device 70 can comprise one or more raised ledges or contact portions 90. In FIG. 2B, contact portions 90 have been hatched or shaded for illustration purposes only and for easier visibility. In some aspects, multiple contact portions 90 can be spaced apart and annularly disposed about connector device 70. In some aspects, contact portions 90 can, but do not have to be spaced apart at regular, equidistant increments about the opening of device 70. Contact portions 90 can be configured to engage portions of an LED module (e.g., 40, FIG. 1). That is, in some aspects connector device 70 can contact an LED module at one or more portions or points, such as for example at at least three spaced-apart points. In other aspects, connector device 70 can contact an LED module in less than three points, but at least two points. In some aspects, connector device 70 can contact an LED module in more than three points, such as four points, five points, six points, multiple points and/or a plurality of points. In any event, connector device 70 can comprise any number of contact portions 90 configured to engage and face an LED module.

Connector device 70 can further comprise one or more alignment members, generally designated 92. In some aspects, alignment members 92 can be configured to align over portions of an LED module (e.g., alignment areas A, FIG. 4B). Alignment members 92 can for example comprise annular ring portions that may or may not have projections for contacting and engaging alignment areas (e.g., areas A, FIG.

4B) of an LED module. In some aspects, alignment members 92 can be configured to ensure proper polarity for electrical connections to LED module.

As FIG. 2C illustrates in a side view, wires 80 can attach directly into a side portion of body 72 of connector device 70. Wires 80 can connect into housing openings 94 of housing portions 86 (FIG. 2B). In some aspects, wires 80 can connect to connector 70 in a direction that is substantially normal or orthogonal to a central axis extending through opening 74, for example, in a direction normal to a longitudinal axis of connector system 10 (FIG. 1). Notably, wires 80 can be configured to be directly received in portions of connector device 70 rather than being directly connected to portions of the LED module (e.g., 40, FIG. 1).

Figure 3:
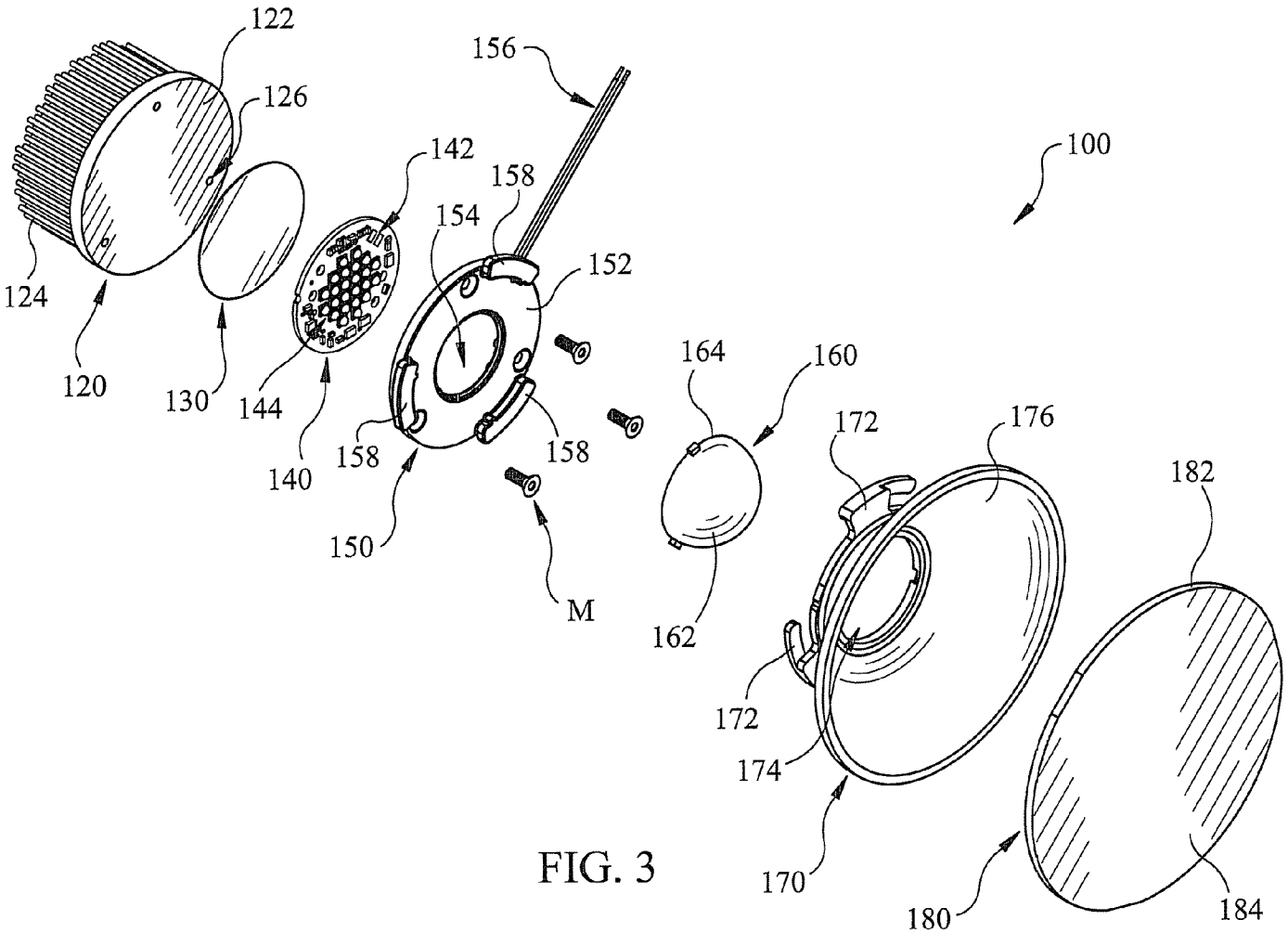
FIG. 3 is an exploded view illustrating a connector system according to another embodiment of the disclosure herein.

Referring now to FIG. 3, another embodiment of a connector system, generally designated 100 is illustrated. Connector system 100 can comprise a heat sink generally designated 120, an optional adhesive or thermal interface material 130, a LED module 140, a connector device 150, and one or more optional mechanical coupling or fastener members M. Each of these components has been previously described with respect to FIG. 1 and can be similar in form and function to previously described respective heat sink 20, material 30, LED module 40, and connector device 50. For example, heat sink 120 can comprise a support surface 122 over which LED module 140 can be disposed. Heat sink 120 can further comprise radially projecting fins 124 and one or more openings configured to receive at least one mechanical coupling member M. Fins 124 can be disposed on a surface of heat sink which opposes the surface to which LED module 140 can be attached or connected. Notably, LED module 140 can be physically constrained via connector device 150 and heat sink 120, but not permanently attached thereto, thus, merely loosening mechanical members M can allow for easy insertion and removal of LED module 140. That is, LED module 140 can be, but does not need to be mechanically coupled to heat sink 120 via mechanical coupling members M. In some aspects, LED module 140 can be slidably received between heat sink 120 and connector 150 upon loosening of coupling members M.

LED module 140 can comprise electrical contacts 142 disposed in a peripheral portion or region. Electrical contacts 142 and other electrical components can be peripherally disposed about a centrally disposed light emission area 144. In some aspects, connector device 150 can be configured to cover electrical components, while light emission area 144 can be uncovered. That is, connector device 150 can comprise an annular body 152 configured to cover at least some of the electrical components of LED module 140, while opening 154 can be configured to maintain LED chips and/or LED packages disposed on LED module 140 exposed, visible, and/or uncovered. Notably, connector device 150 can mechanically couple LED module 140 to heat sink 120 and can also mechanically couple LED module 140 to optional primary or secondary optics. In addition to providing mechanical coupling capabilities, connector device 150 can further electrically couple LED module 140 to a power source or fixture having electrically conductive wires 156. As can be appreciated, the act of connector device engaging and holding down LED module 140 simultaneously electrically couples LED module 140 also where electrical connection is already provided to connector device 150 such as by attachment of wires 156.

Notably, connector system 100 can further comprise one or more optional primary or secondary optics. Such optics can comprise one or more optical elements such as a dome, lens, bulb, reflector, diffuser, and/or combinations thereof. Such optics can be used alone, or in combination to produce any desired shape, color point, and/or pattern of light.

In one aspect, connector system 100 can comprise an optional diffusing bulb generally designated 160. Diffusing bulb 160 can comprise a dome shaped outer surface 162 and an opposing inner surface 164. In some aspects, dome shaped outer surface 162 and/or inner surface 164 can be textured. In other aspects, dome shaped outer surface 162 and/or inner surface 164 can be painted, sprayed, layered, or otherwise coated with an optical conversion material, such as a phosphor, lumiphore, and/or binder. In other aspects, optical conversion material can be disposed directly over LED chips and/or LED packages disposed on LED module 140. Diffuser bulb 160 can be easily installed via snapping or locking bulb over portions of connector. Diffuser bulb 160 can comprise any suitable material, for example, glass, polymer, silicone, and/or plastic. Diffuser bulb 160 can comprise any transparent, semi-transparent, or suitable material configured to diffuse light.

Still referring to FIG. 3, connector system 100 can further comprise one or more optional reflectors, generally designated 170. Reflector 170 can comprise one or more tab portions 172 configured to matingly engage with tabs 158 of connector device 150. In some aspects, tab portions 172 can be configured to slide over and/or about tabs 158 of connector device 150 to secure reflector 170 to connector device 150. Reflector 170 can further comprise an opening 174 thorough which light can be emitted. In some aspects, a portion of diffuser bulb 160 can be disposed in a portion of opening 174. In other aspects, LED module 140 can be disposed through a portion of opening 174. Notably, reflector 170 can provide easy installation via sliding or otherwise coupling to connector device 150.

In further aspects, reflector 170 can comprise a reflector cone that can comprise an outwardly sloped and/or radially extending reflector surface 176. In some aspects, reflector surface 176 can comprise a reflective coating. In other aspects, reflector surface 176 can comprise a coating including one or more phosphors, lumiphores, and/or binders. Reflector 170 can comprise any suitable material, for example, glass, polymer, metal, silicone, and/or plastic. Where used, optical conversion material described throughout this disclosure can be configured to emit red light, blue light, green light, yellow light, combinations thereof, or white light upon impingement of light emitted by one or more LED chips or packages of LED module 140. LED module 140 can comprise packages configured to emit light of a same color and/or at least two different colors including packages emitting light that can be primarily blue, primarily green, primarily cyan, primarily red, primarily yellow, primarily orange, and/or any combination thereof. In some aspects, LED module 140 can comprise multiple LED chips or packages configured to emit multiple different colors.

In some aspects, an optional lens 180 can be provided. In some aspects, lens 180 can be provided over a portion of reflector 170. In some aspects, lens 180 can comprise a first surface 182 adjacent to and/or facing reflector surface 176. Lens 180 can comprise a second, outer surface 184 opposing first surface 182. Lens 180 can be used alone and/or in combination with any one of diffuser bulb 160 and/or reflector 170. In some aspects, first and/or second surfaces 182 and/or 184 can be coated with a phosphor, lumiphore, and one or more binders. In some aspects, lens 180 can comprise a diffuser lens configured to diffuse light. In some aspects, lens 180 can comprise a textured surface. In some aspects, lens 180, reflector 170, and/or bulb 160 can be configured to achieve a white color point, such as a minimum of 90 CRI and approximately 2700° K to approximately 4000° K. Notably, lens 180, reflector 170, and/or bulb 160 can be interchangeable. That is, optical elements described herein can comprise interchangeable optical elements such as a reflector cone, diffuser and lens. The interchangeable optical elements can vary in size and/or shape to determine beam angles, beam pattern, and cutoff angles. In some aspects, connector system 100 can be configured to provide lighting for personal and/or commercial applications where high CRI, luminous flux and efficacy are desired or required.

Figure 4A:
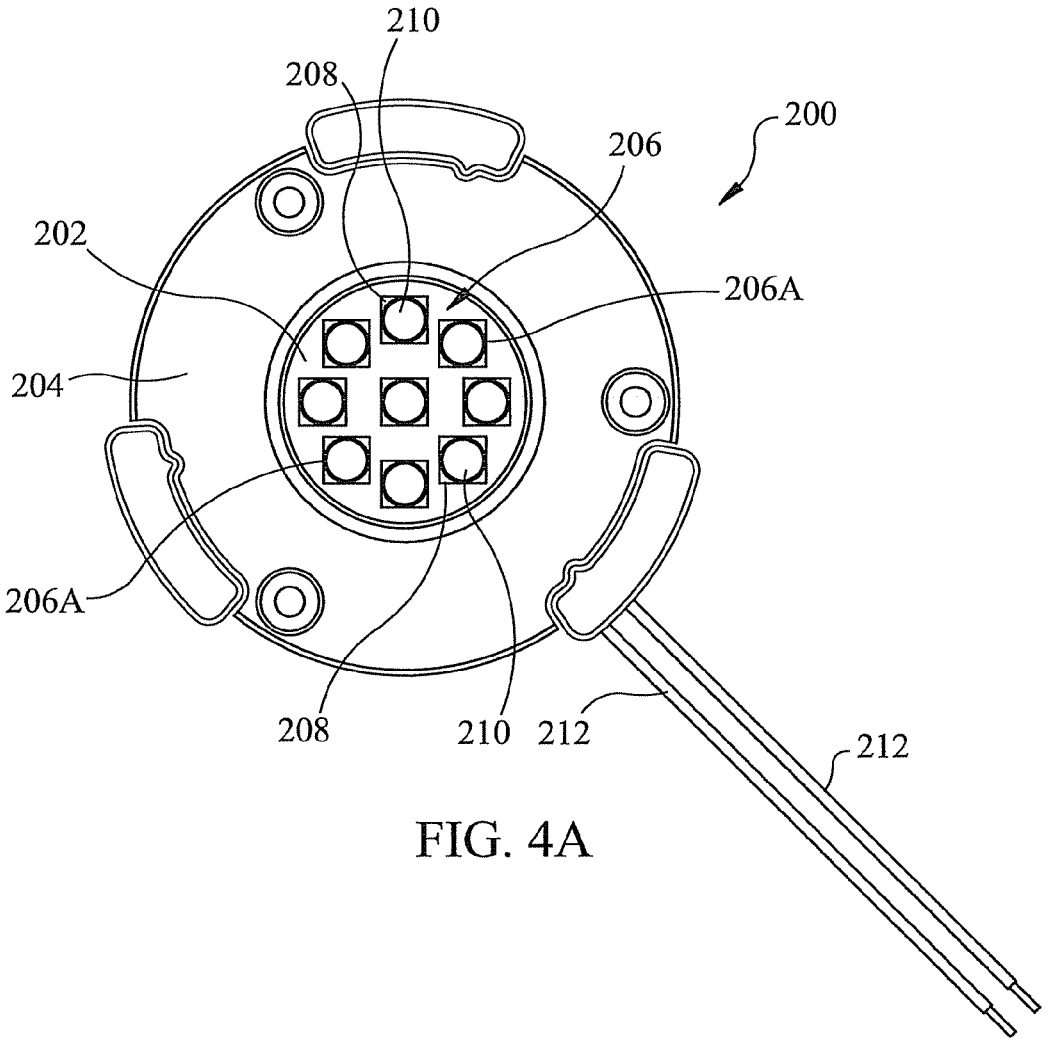
FIG. 4A is a top plan view illustrating a connector system according to another embodiment of the disclosure herein.
Figure 4B:
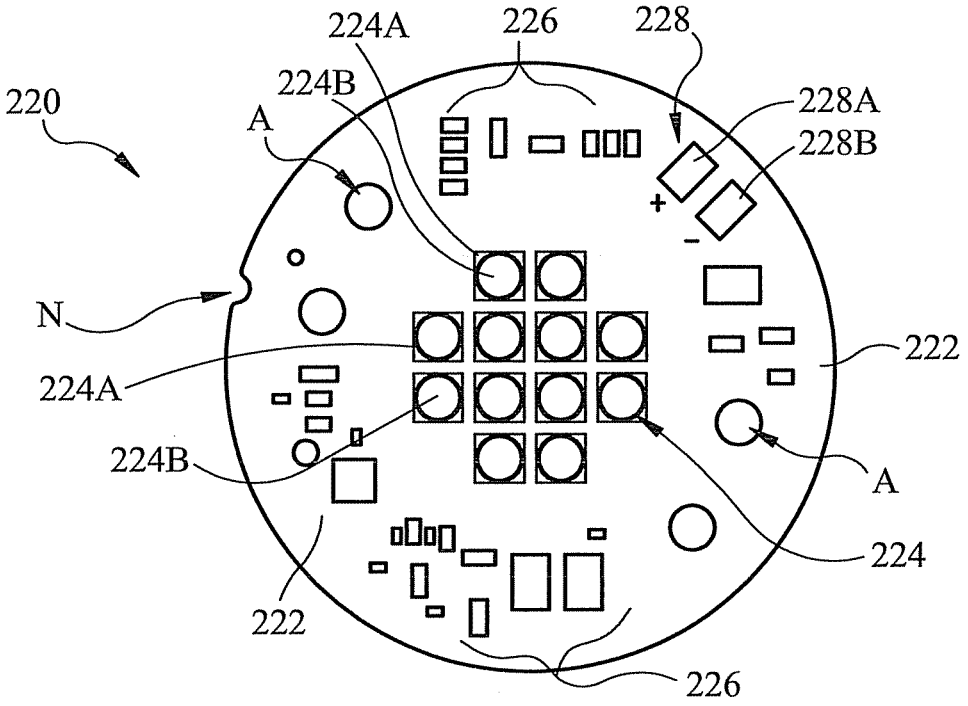
FIGS. 4B, 4C and 4D are top views illustrating light emitting diode (LED) chip based modules or LED modules according to embodiments of the disclosure herein.
Figure 4C:
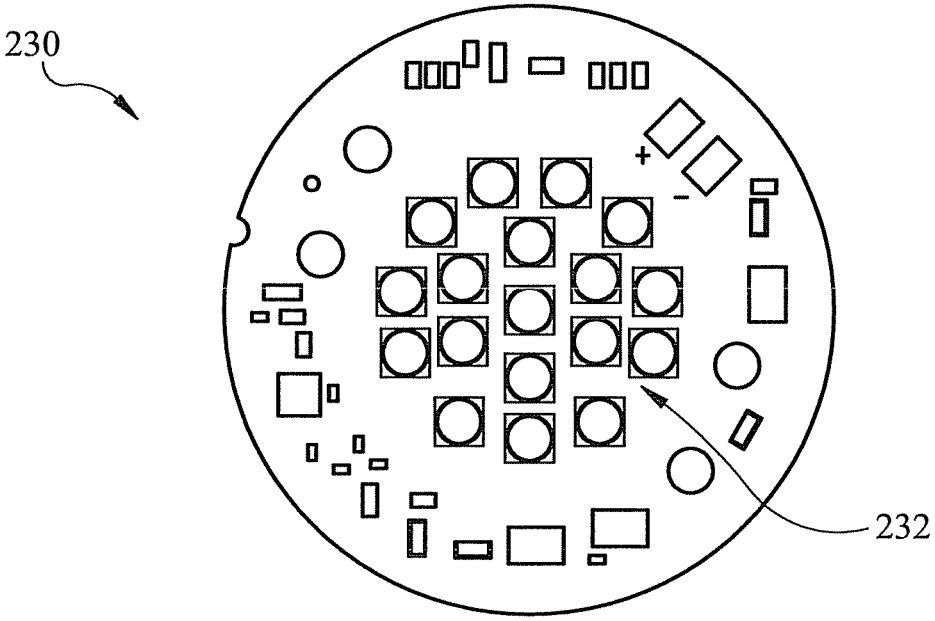
Figure 4D:
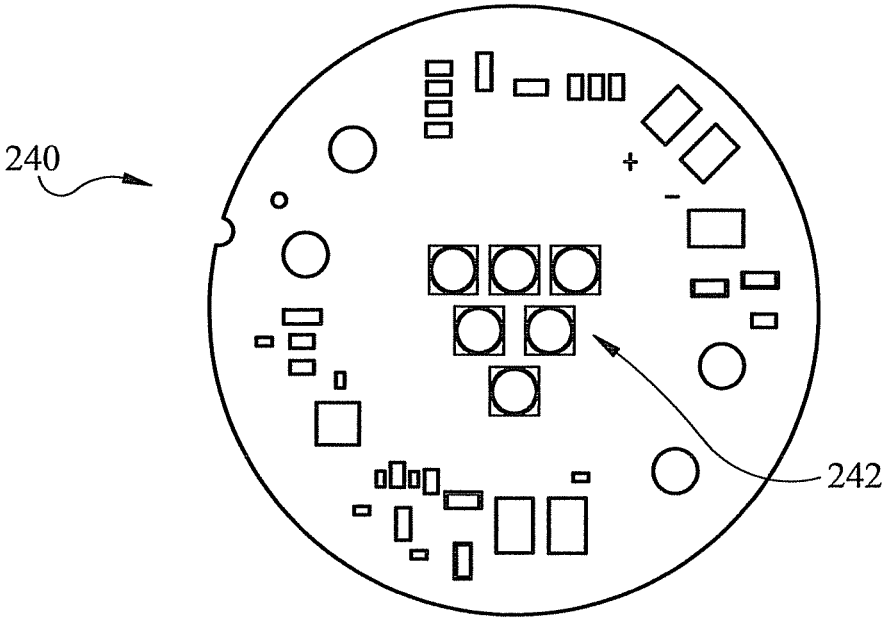

FIG. 4A is a top plan view of a connector system, generally designated 200. Connector system 200 comprises an LED module secured within a connector. FIGS. 4B to 4D are top plan views of various LED modules configured for use with a connector device. As FIG. 4A illustrates, the connector is configured cover one or more electrical components disposed on the substrate of the LED module, while one or more light emitters of the LED module are left exposed or uncovered, and are visible through a portion of an opening of the connector.

Referring to FIG. 4A, connector system generally designated 200 comprises an LED module 202 secured within a connector having a connector body 204. Connector body 204 can be disposed about a light emitter portion 206 of the LED module. In some aspects, connector body 204 can comprise an annular ring having an opening through which emitter portion 206 can be disposed. In some aspects, at least a portion of connector body 204 and LED module 202 can be coaxial. Notably, electrical components (other than the LED chips) disposed on portions of LED module 202 can be at least partially or completely covered by connector body 204. Thus, such electrical components can be obstructed from view and not visible when LED module 202 is secured within connector body 204. Covering electrical components, including electrical contacts, can reduce absorption, blockage, and/or general interference of light by electrical components.

Light emitter portion 206 of LED module 202 can comprise multiple light emitters, such as LED chips and/or LED packages 206A. Each of LED packages 206A can comprise a substrate or submount 208 and an optical element, such as a lens 210, that can serve as a primary optic. A secondary optic can also be engaged by the connector in some aspects as for example an optical element as described further herein. In some aspects, each LED module can for example comprise chip on board (COB) LED chips provided thereon. The COB LED chips can be encapsulated and/or be covered at least partially by a lens. In some aspects, LED chips within LED packages 206A can be at least partially covered by one or more phosphors. In other aspects, at least a portion of lens 210 can be at least partially coated or covered by one or more phosphors. In some aspects, multiple LED packages 206A and/or LED chips of LED module 202 can comprise multiple LED chips configured to emit light of multiple different wavelengths or color points. The light from the LED chips can be mixed via optical elements of connector system, to produce white light. In other aspects, LED packages 206A and/or LED chips of LED module 202 can comprise multiple LED chips configured to emit light of a same wavelength and/or a same color point.

LED module 202 can comprise any number and/or arrangement of LED packages 206A. For example, LED module 202 can comprise one, two, more than two LED packages 206A, more than three LED packages 206A, more than five LED packages 206A, more than seven LED packages, and/or nine or more LED packages 206A as shown. In some aspects LED module can for example comprise 24 LED packages (e.g., FIG. 3). At least a first LED package can be disposed proximate a center of LED module 202, and multiple packages can be peripherally disposed about the center LED package.

Connector system 200 can be configured to electrically connect wires 212 to portion of LED module 202 as previously described. Wires 212 can be inserted into housings of connector, and electrical current carried via wires 212 can pass into connector and LED module 202 via conductive components or circuitry. In some aspects, electrical connection between LED module 202 and wires 212 can comprise a solderless connection.

Referring to FIGS. 4B, 4C and 4D, various embodiments of LED modules are illustrated. LED modules can vary in size, shape, number, and/or placement of LED chips or LED packages. FIG. 4B is one embodiment of an LED module, generally designated 220. LED module 220 can comprise a substrate 222 over which one or more COB LED chips or LED packages, generally designated 224 can be disposed. LED chips and/or LED packages 224 can be disposed over a first portion of substrate 222, and electrical components 226 can be disposed over a second portion of substrate 222. In some aspects, LED packages 224 can be disposed over a centralized portion of substrate 222, and electrical components 226 can be disposed over a peripheral portion of substrate.

In some aspects, substrate 222 can comprise a portion of a printed circuit board (PCB), a metal core printed circuit board (MCPCB), a flexible printed circuit board, a dielectric laminate (e.g., FR-4 boards as known in the art) or any suitable substrate for mounting LED chips and/or LED packages. In some aspects, substrate 222 can comprise one or more materials arranged to provide desired electrical isolation and high thermal conductivity. In some aspects, at least a portion of substrate 222 can comprise a dielectric to provide the desired electrical isolation between electrical traces or components of multiple LEDs, LED sets, and/or multiple LED packages. In some aspects, substrate 222 can comprise ceramic such as alumina, aluminum nitride, silicon carbide, or a polymeric material such as polyimide, polyester, etc. In some aspects, substrate 222 can comprise a flexible circuit board which can allow the substrate to take a non-planar or curved shape allowing for directional light emission with the LED chips also being arranged in a non-planar manner.

In some aspects, at least a portion of substrate 222 can comprise a MCPCB, such as a "Thermal-Clad" (T-Clad) insulated substrate material, available from The Bergquist Company of Chanhassen, Minn. A MCPCB substrate may reduce thermal impedance and conduct heat more efficiently than standard circuit boards. In some aspects, a MCPCB can also comprise a base plate on the dielectric layer, opposite the LED packages, and can comprise a thermally conductive material to assist in heat spreading. In some aspects, the base plate can comprise different material such as copper, aluminum or aluminum nitride. The base plate can have different thicknesses, such within the range of 100 μm to 2000 μm. Substrate 222 can comprise any suitable material and any suitable thickness, such as from approximately 0.5 mm to more than 5 mm and any sub-range therebetween.

In some aspects, substrate 222 can comprise a width that is more than approximately 5 mm. In some aspects, substrate 222 can comprise a width (or diameter) that is approximately 20 mm or more, approximately 25 mm or more, approximately 30 mm or more, approximately 40 mm or more, or approximately 50 mm or more. In some aspects, substrate 222 can comprise width that is approximately 43 mm. Notably, connector devices and/or systems disclosed herein can vary in size and/or shape to accommodate multiple sized LED modules.

LED packages 224 can each comprise a mounting substrate or submount 224A and a lens 224B. In some aspects, more than ten LED packages 224 can be provided over substrate 222. For example, LED module 220 can comprise twelve LED packages 224 arranged in multiple rows and/or columns. In some aspects, LED module 220 can comprise twelve LED packages 224 that can for example be arranged in four rows and four columns as shown, where first and last rows and/or columns comprise two LED packages and the middle rows and/or columns comprise four LED packages. In some aspects, LED packages 224 can be, but do not have to be arranged in a symmetrical arrangement. Submount 224A can comprise any suitable material, for example, a metal, plastic, ceramic, or combinations thereof. In some embodiments, submount 224A can comprise a ceramic based submount comprising alumina ($Al_2O_3$), or aluminum nitride AlN, however, any material is contemplated.

As noted above, electrical components 226 can be peripherally disposed about LED packages 224. Electrical components 226 can be disposed adjacent or proximate edges of substrate 222. Electrical components 226 can be covered by connector devices within a connector system (e.g., FIG. 4A). Electrical components can comprise electrical contacts 228 including a first contact 228A and a second contact 228B comprising an anode cathode pair. As described earlier, electrical contacts 228 can be deposited, applied, plated, over substrate 222. In other aspects, electrical contacts 228 can comprise push pin contacts, IDC connectors, or any other connector configured to engage or crimp wires (e.g., FIG. 4A) such that the need for solder is obviated.

In some aspects, electrical components 226 can comprise micro-processing circuitry and/or devices, current diversion circuits and/or devices such as at least one transistor, resistor, and diode arranged in parallel with some of the LED packages 224 to divert current about and thereby activate, deactivate, and/or dim and/or one or more LED packages 224 during operation. Electrical components 226 can also comprise multiple transistors, resistors, and/or diodes. In some aspects, electrical components 226 can further comprise at least one surge protection element or surge protection such as a metal oxide varistor (MOV). However, any suitable surge protection device or surge protection circuit configured to protect LED chips or packages from voltage spikes is contemplated. In certain embodiments, surge protection components and/or micro-processing circuitry can be directly supported and attached to portions of substrate 222.

Notably, one or more alignment areas A can be provided within and/or over substrate 222. Alignment areas A can for example comprise openings, holes, or other areas which can be easily aligned to portions of a connector. Notably alignment areas A can be automatically aligned within and/or over alignment members (e.g., 92, FIG. 2B) during insertion of LED module 220 within a connector to ensure the proper electrical polarity for electrical connections to LED module. One or more notches N can also be provided in substrate 222 for alignment purposes FIG. 4C illustrates an LED module generally designated 230 similar in form and function to LED module 220. In some aspects, LED module 230 can comprise a plurality of LED packages 232. In some aspects, more than fifteen LED packages 232 can be provided over substrate. For example, in some aspects eighteen LED packages 232 can be provided over a centralized portion of substrate. LED packages 232 can but do not have to be symmetrically aligned. LED packages 232 can, but do not have to be arranged in a circular arrangement.

FIG. 4D is another embodiment of an LED module, generally designated 240. LED module 240 can comprise less than ten LED packages 242, for example, six LED packages 242. In this aspect, LED packages 242 can be arranged in a non-circular arrangement, such as in a square, rectangle, or triangular arrangement. In some aspects, LED packages 242 can be arranged in multiple groups over multiple portions of substrate of LED module 240.

In accordance with the disclosure herein, and with any of the embodiments described or understood from the disclosure herein and accompanying drawings, the connector can comprise metal (no current passing through the connector so as to be non-shorting) or plastic (thermally conductive plastic for example) and can also have thermal conducting properties to improve the heat transfer from the LED module to the heatsink. A connector as shown for example in any of the embodiments here can therefore act as a top side heatsink or thermal conduit to further dissipate heat. A thermally conductive gap filling material (electrically isolating) can also optionally be added to an underside of the connector, such as to the portion configured to cover electrical components, to create an intimate thermal connection between the LED module and the electrical components on the LED module. This can further improve heat transfer from the LED module to the heatsink, reflector and surroundings. The connector can also provide a thermal connection between the LED module and a thermally conductive reflector cone as a thermal path through the reflector cone to cooler ambient temperatures improves the performance of the LED module by sinking heat to a cooler location. It is also understood by those of skill in the art that a connector such as any connector described herein can be electrically isolating (high dielectric) and thermally conductive. When secured in place, a connector according to the any embodiment disclosed herein applies even force across the LED module to make good thermal contact with a heatsink through the thermal interface material. Also when secured, a connector applies an even and sustained contact force across the LED module contact points to make secure and reliable electrical contact. Furthermore, the LED module can be driven by DC current (for example in a range of 200 mA-1500 mA (or greater range) at 15-50 VDC) or by AC current as needed. A separate AC-DC constant current supply can be provided that can provide the drive voltage and current. In some aspects, embodiments could comprise high voltage LEDs driven by AC power.

LED modules can further comprise one or more LED chips encapsulated within a filling material and having a retention material disposed about the filing material. One example of this feature is described in commonly assigned U.S. patent application Ser. No. 13/028,972 filed on Feb. 16, 2011, the contents of which are fully incorporated herein by reference.

LED modules secured within connector devices and/or systems described herein can, for example, be configured to deliver approximately 70 LPW or more in select color temperatures, such as cool white or warm white color temperatures (e.g., from approximately 2700° to 7000° K). LED modules secured within connector devices and/or systems described herein can be configured to deliver approximately 80 LPW or more in select color temperatures, such as cool white or warm white color temperatures. LED modules secured within connector devices and/or systems described herein can be configured to deliver approximately 90 LPW or more in select color temperatures, such as warm white color temperatures (e.g., from approximately 2700° to 5000° K).

In some aspects, LED modules and/or connector devices and systems described herein can be operable at approximately 120 volts (V) or more, approximately 230 V or more, and/or approximately 277 V or more. LED modules and/or connector devices and systems can also be dimmable via electrical components disposed on the module. In some aspects, LED modules and/or connector devices and systems can be dimmable by more than 1%, such as approximately 5%, approximately 10% or approximately 50%. In some aspects, LED modules and/or connector devices and systems described herein can be configured to emit approximately 700 lumens (lms) or more, approximately 850 lms or more, approximately 1250 lms or more, approximately 2000 lms or more, or more than approximately 3000 lms.

Embodiments as disclosed herein may provide one or more of the following beneficial technical effects: reduced cost of providing connector devices and/or systems for light emitter components such as LED modules; ease of manufacture; ease of installation; high brightness; improved reliability; improved ability to accommodate LED modules of various sizes and/or shapes; improved brightness; improved thermal properties and/or thermal management; improved color mixing; and/or interchangeable optics for producing a desired beam size, pattern, color point and/or cutoff angles.

While the connector devices, systems, and methods have been described herein in reference to specific aspects, features, and illustrative embodiments, it will be appreciated that the utility of the subject matter is not thus limited, but rather extends to and encompasses numerous other variations, modifications and alternative embodiments, as will suggest themselves to those of ordinary skill in the field of the present subject matter, based on the disclosure herein. Various combinations and sub-combinations of the structures and features described herein are contemplated and will be apparent to a skilled person having knowledge of this disclosure. Any of the various features and elements as disclosed herein may be combined with one or more other disclosed features and elements unless indicated to the contrary herein. Correspondingly, the subject matter as hereinafter claimed is intended to be broadly construed and interpreted, as including all such variations, modifications and alternative embodiments, within its scope and including equivalents of the claims.

What is claimed is:

1. A connector device for securing a light emitting diode (LED) module that comprises a plurality of separate and individual light emitters, the connector device comprising:

a connector body comprising a first side configured to engage the LED module to hold the LED module in place against a first surface, and a second side configured to engage an optical element for mechanically coupling the LED module to the optical element;

the connector body being configured to receive a portion of an electrical wire, whereby engagement of the LED module by the first side of the connector body also electrically couples the LED module to the electrical wire; and the connector body comprising an opening extending between the first surface on the first side and a second surface on the second side, wherein a plurality of tabs extend from the second surface and are disposed above the second surface and above the opening for engaging the optical element.

2. The connector device of claim 1, wherein the optical element comprises a diffusing bulb.

3. The connector device of claim 1, wherein the optical element comprises a reflector.

4. The connector device of claim 1, wherein the optical element comprises a diffusing lens.

5. The connector device of claim 1, wherein the optical element is configured to slide over the tabs extending from the second side of the connector body.

6. The connector device of claim 1, wherein the connector body comprises an annular ring.

7. The connector device of claim 6, wherein a portion of the annular ring is configured to cover one or more electrical components disposed on the LED module.

8. The connector device of claim 1, wherein the connector body comprises one or more raised contact portions on the first side of the connector body for engaging the LED module.

9. The connector device of claim 1, wherein the connector body contacts the LED module in only three points.

10. The connector device of claim 1, wherein the connector body contacts the LED module in only two points.

11. The connector device of claim 1, wherein the connector body contacts the LED module in more than three points.

12. The connector device of claim 1, further comprising at least one side opening for receiving the wire, wherein the at least one side opening is disposed in a lateral side wall between the first surface and the second surface.

13. The connector device of claim 1, wherein the connector body is reflective.

14. The connector device of claim 1, wherein the connector body comprises plastic or ceramic.

15. The connector device of claim 1, wherein the connector body comprises a reflective coating.

16. The connector device of claim 1, wherein the connector body is configured to engage a thermal substrate.

17. The connector device of claim 1, wherein the connector body comprises a thermally conductive material.

18. The connector device of claim 17 wherein the connector body comprises plastic.

19. The connector device of claim 17 wherein the connector body comprises metal.

20. A connector device for securing a light emitting diode (LED) module, the connector device comprising:

a connector body comprising a first side configured to engage the LED module, the connector body comprising a centrally disposed opening extending between a planar upper surface and a planar lower surface; and a plurality of tabs extending above the planar upper surface and above the opening for engaging an optical element.

21. The connector device of claim 20, further comprising one or more raised contact portions disposed along the first side of the connector body, wherein the connector body is configured to physically contact the LED module only at the one or more raised contact portions and wherein the one or more raised contact portions are spaced apart at regular intervals about the opening of the connector body.

22. The connector device of claim 20, wherein the optical element comprises a diffusing bulb.

23. The connector device of claim 20, wherein the optical element comprises a reflector.

24. The connector device of claim 20, wherein the optical element comprises a diffusing lens.

25. The connector device of claim 20, wherein the optical element is configured to slide over tab portions extending from the connector body.

26. The connector device of claim 20, wherein the connector body contacts the LED module at only three contact portions.

27. The connector device of claim 20, wherein the connector body contacts the LED module at only two contact portions.

28. The connector device of claim 20, wherein the connector body is reflective.

29. The connector device of claim 20, wherein the connector body comprises plastic or ceramic.

30. The connector device of claim 20, wherein the connector body comprises a reflective coating.

31. The connector device of claim 20, wherein the connector body is configured to engage a thermal substrate.

32. The connector device of claim 20, wherein the connector body is configured to cover electrical components of the LED module.

33. The connector device of claim 20, wherein the connector body comprises a thermally conductive material.

34. The connector device of claim 20 wherein the connector body comprises plastic.

35. The connector device of claim 20 wherein the connector body comprises metal.

36. A connector system for connecting a light emitting diode (LED) module to a substrate, the connector system comprising:

a connector comprising a body that defines an opening;

at least one LED module disposed in a portion of the connector, the LED module comprising:

a substrate;

one or more light emitters disposed on the substrate; and one or more electrical components disposed on the substrate; and wherein, when the at least one LED module is disposed in a portion of the connector, the one or more electrical components are covered and not visible and the one or more light emitters are visible through a portion of the opening; and wherein the opening extends between a reflective, planar upper surface of the body and a parallel planer lower surface of the body, and wherein a side opening is disposed in a lateral side wall of the body between the upper surface and the lower surface, the lateral side opening being configured to receive one or more electrical components.

37. The connector system of claim 36, wherein the body is annular and covers a portion of the one or more electrical components.

38. The connector system of claim 36, wherein the LED module comprises six or more light emitters.

39. The connector system of claim 36, wherein the LED module comprises 12 or more light emitters.

40. The connector system of claim 36, wherein the LED module comprises 24 or more light emitters.

41. The connector system of claim 36, wherein the light emitters comprise LED packages.

42. The connector system of claim 36, wherein the substrate is more than 5 millimeters (mm) in diameter.

43. The connector system of claim 36, wherein the substrate is more than 25 millimeters (mm) in diameter.

44. The connector system of claim 36, wherein the substrate is more than 40 millimeters (mm) in diameter.

45. The connector system of claim 36, further comprising one or more raised contact portions that are spaced apart at regular intervals about the opening of the connector body.

46. The connector system of claim 36, wherein the LED module is disposed between the body and a thermal substrate.

47. The connector system of claim 46, further comprising a thermal interface material disposed between the LED module and the thermal substrate.

48. The connector system of claim 36, further comprising an optical element.

49. The connector system of claim 48, wherein the optical element comprises a diffusing bulb.

50. The connector system of claim 48, wherein the optical element comprises a reflector.

51. The connector system of claim 48, wherein the optical element comprises a diffusing lens.

52. The connector system of claim 48, wherein the optical element is configured to slide over tab portions extending from the body.

53. The connector system of claim 36, wherein the body contacts the LED module at only three contact portions.

54. The connector system of claim 36, wherein the connector body is reflective.

55. The connector system of claim 36, wherein the connector body comprises plastic or ceramic.

56. The connector system of claim 36, wherein the substrate of the LED module comprises alumina or aluminum nitride.

57. The connector system of claim 36, wherein the LED module comprises a micro-processor disposed on the substrate.

58. The connector device of claim 36, wherein the connector body comprises a thermally conductive material.

59. The connector device of claim 36 wherein the connector body comprises plastic.

60. The connector device of claim 36 wherein the connector body comprises metal.

61. A method of connecting a light emitting diode (LED) module to another component, the method comprising:

providing a connector with a connector body and an opening;

providing an LED module over a first side of the connector body;

positioning an optical element over a tab provided on a second side of the connector body, wherein the tab extends above the opening of the connector body; and inserting an electrical wire into the connector body for electrically coupling the wire to the LED module.

62. The method of claim 61, wherein the connector comprises an annular shaped body defining the opening.

63. The method of claim 62, wherein providing the LED module comprises positioning a central portion of the LED module through the opening of the annular shaped body.

64. The method of claim 62, wherein a portion of the annular shaped body covers one or more electrical components disposed on the LED module.

65. The method of claim 62, wherein the LED module comprises one or more LED packages disposed over a substrate.

66. The method of claim 61, wherein the optical element comprises a reflector.

67. The method of claim 61, wherein the optical element comprises a diffusing lens.

68. The method of claim 61, wherein the optical element is configured to slide over the tab.

69. The method of claim 61, further comprising coupling the LED module to a thermal substrate.

70. The method of claim 61, further comprising applying a reflective coating over at least a portion of the connector.

71. A connector system comprising:

a light emitting diode (LED) module comprising at least one light emitter, the light emitter comprising a submount;

a connector body comprising a first side configured to engage the LED module to hold the LED module in place against a surface, a second side configured to engage an optical element, and one or more tab portions, wherein the tab portions of the connector body extend a furthest distance away from the connector body than any other portion of the connector body; and whereby engagement of the LED module by the first side of the connector body also electrically couples the LED module to the connector device.

72. The component system of claim 71 wherein the at least one light emitter comprises at least one primary optic.

73. The component system of claim 72 wherein the connector body is engaged with the optical element as a secondary optic.

* * * * *